US009771798B2

(12) United States Patent
Gilbert et al.

(10) Patent No.: US 9,771,798 B2
(45) Date of Patent: Sep. 26, 2017

(54) SINGLE PHASE CAPTURE AND CONVEYANCE WHILE DRILLING

(71) Applicant: Schlumberger Technology Corporation, Sugar Land, TX (US)

(72) Inventors: Andrew Gilbert, Aberdeen (GB); Steve Ellis, Gatwick (GB); Sebastien Ives, Rosharon, TX (US); Gary Whatford, Aberdeen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 302 days.

(21) Appl. No.: 14/571,238

(22) Filed: Dec. 15, 2014

(65) Prior Publication Data

US 2016/0168989 A1 Jun. 16, 2016

(51) Int. Cl.
*E21B 49/08* (2006.01)

(52) U.S. Cl.
CPC ..... *E21B 49/081* (2013.01)

(58) Field of Classification Search
CPC ..... E21B 49/08; E21B 49/081
USPC ..... 175/58, 59; 166/264
See application file for complete search history.

(56) References Cited

U.S. PATENT DOCUMENTS

| | | | | |
|---|---|---|---|---|
| 3,095,930 | A * | 7/1963 | Kisling, III | E21B 49/082 166/110 |
| 3,556,211 | A * | 1/1971 | Bohn | E21B 49/082 166/163 |
| 5,009,100 | A * | 4/1991 | Gruber | E21B 49/082 73/152.28 |
| 5,337,822 | A | 8/1994 | Massie et al. | |
| 6,439,307 | B1 * | 8/2002 | Reinhardt | E21B 49/082 166/169 |
| 7,191,672 | B2 | 3/2007 | Ringgenberg et al. | |
| 7,243,536 | B2 | 7/2007 | Bolze et al. | |
| 7,246,664 | B2 | 7/2007 | Shammai et al. | |
| 7,596,995 | B2 | 10/2009 | Irani et al. | |
| 7,621,325 | B2 | 11/2009 | Shammai et al. | |
| 7,913,775 | B2 * | 3/2011 | Jeffryes | E21B 10/00 175/249 |
| 8,371,161 | B2 | 2/2013 | Simpson et al. | |
| 8,429,961 | B2 * | 4/2013 | Irani | E21B 41/00 73/152.23 |
| 9,506,307 | B2 * | 11/2016 | Kinsella | E21B 25/02 |
| 2004/0129070 | A1 * | 7/2004 | Bolze | E21B 49/081 73/152.02 |
| 2010/0326727 | A1 | 12/2010 | Villareal et al. | |

* cited by examiner

*Primary Examiner* — Kenneth L Thompson
(74) *Attorney, Agent, or Firm* — Cameron R. Sneddon

(57) ABSTRACT

Methods and devices for collecting fluid include a self-closing system that automatically halts fluid collection once a sufficient amount of fluid has been collected and a locking mechanism that automatically activates a pressure compensation system in order to maintain the collected fluid in the same phase in which it was collected.

20 Claims, 7 Drawing Sheets

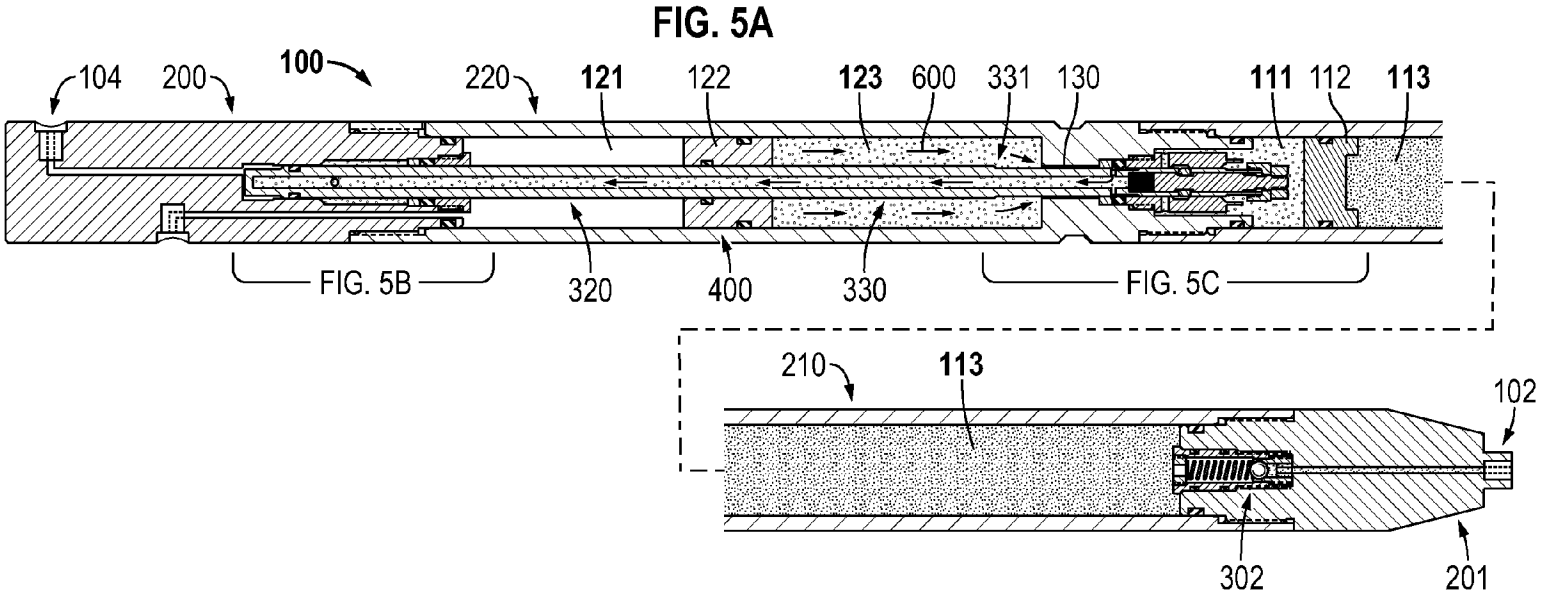
FIG. 5A
100
104
200
220
121
122
123
600
331
130
111
112
113
320
400
330
FIG. 5B
FIG. 5C
210
113
302
201
102
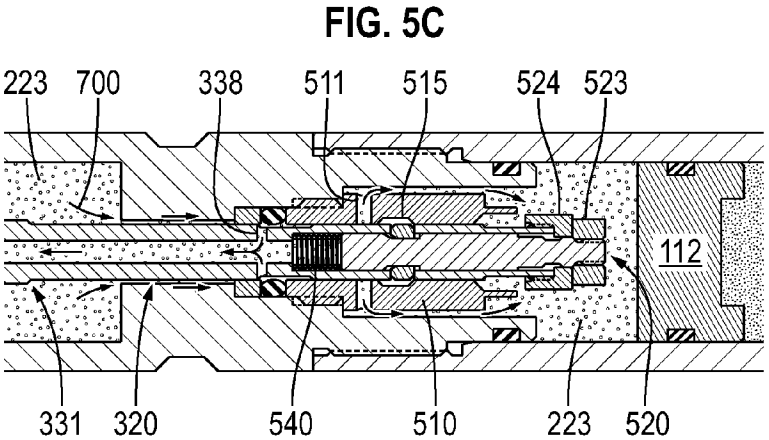
FIG. 5C
223
700
338
511
515
524
523
112
520
223
510
540
320
331
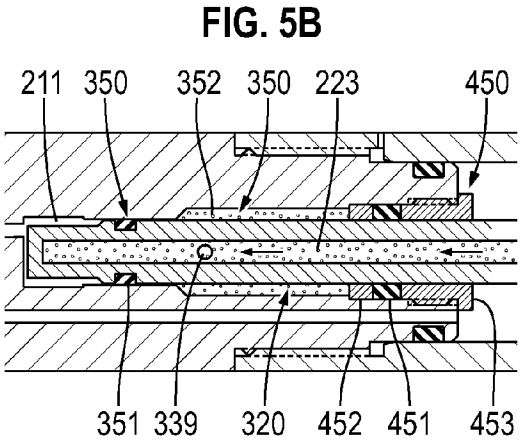
FIG. 5B
211
350
352
350
223
450
453
451
452
320
339
351

SINGLE PHASE CAPTURE AND CONVEYANCE WHILE DRILLING

BACKGROUND

Field

This disclosure relates to samplers and more particularly to oil and gas single phase fluid samplers that may be used in the oil field industry.

Description of the Related Art

Hydrocarbons are widely used as a primary source of energy, and have a great impact on the world economy. Consequently, the discovery and efficient production of hydrocarbon resources is increasingly noteworthy. As relatively accessible hydrocarbon deposits are depleted, hydrocarbon prospecting and production has expanded to new regions that may be more difficult to reach and/or may pose new technological challenges. During typical operations, a borehole is drilled into the earth, whether on land or below the sea, to reach a reservoir containing hydrocarbons. Such hydrocarbons are typically in the form of oil, gas, or mixtures thereof which may then be brought to the surface through the borehole.

During the drilling operation, it may be desirable to perform various evaluations of the formations penetrated by the wellbore. In some cases, the drilling tool may be provided with devices to test and/or sample the surrounding formation. Sometimes, the drilling tool may be removed and a wireline tool may be deployed into the wellbore to test and/or sample the formation. These samples and/or tests may be used, for example, to locate valuable hydrocarbon deposits. Formation evaluation often entails drawing fluid from the formation into the downhole tool for testing and/or sampling.

In cases where a sample of fluid drawn into the tool is desired, a sample may be collected in one or more sample chambers or bottles positioned in the downhole tool. Despite advancements in sampling technology, there remains a need to provide sample chamber and/or sampling techniques capable of providing more efficient sampling in harsh drilling environments, particularly for sampling while drilling.

SUMMARY

Certain aspects of some embodiments disclosed herein are set forth below. It should be understood that these aspects are presented merely to provide the reader with a brief summary of certain forms the embodiments might take and that these aspects are not intended to limit the scope of the disclosure. Indeed, the disclosure may encompass a variety of aspects that may not be set forth below.

In some embodiments, a downhole sampling tool for obtaining fluid from a subsurface formation penetrated by a wellbore includes an inlet and an outlet for establishing fluid communication between the formation and the downhole tool. The downhole tool includes a first piston movably disposed within a first chamber, the first chamber fluidly communicating with the inlet, a second piston movably disposed within a second chamber, and a first passageway fluidly communicating with the first chamber and the second chamber. A rod, having a first end, a second end, and a shaft, passes through the second piston and is movably disposed within the first chamber, the second chamber, and the first passageway. The rod is adapted to be biased in an axial direction when subjected to a pressurized fluid within the second chamber.

In some embodiments, a method of obtaining a sample of fluid from a subsurface formation penetrated by a wellbore includes positioning a downhole sampling tool within the wellbore. The downhole sampling tool includes an inlet and an outlet for establishing fluid communication between the formation and the downhole tool. The downhole sampling tool includes a first chamber divided by a first piston into a variable-volume buffer fluid compartment and a variable-volume sample fluid compartment. A second chamber of the downhole sampling tool is divided by a second piston into a variable-volume pressurized gas compartment and a variable-volume power fluid compartment. A rod, having a first end, a second end, and a shaft, passes through the second piston and is movably disposed within the first chamber, the second chamber, and a first passageway fluidly communicating with the first chamber and the second chamber. The rod is biased towards the second chamber. The method also includes collecting formation fluid by flowing formation fluid into the sample fluid compartment through the inlet, expelling buffer fluid in the buffer fluid compartment to the wellbore through a second passageway formed within the rod and the outlet, and activating a pressure compensation system with the rod in order to maintain the collected formation fluid in the same phase as in the formation.

In some embodiments, a device for collecting fluid includes a self-closing system that automatically halts fluid collection once a sufficient amount of fluid has been collected and a locking mechanism that automatically activates a pressure compensation system in order to maintain the collected fluid in the same phase in which it was collected.

BRIEF DESCRIPTION OF THE DRAWINGS

So that the manner in which the above recited features can be understood in detail, a more particular understanding may be had when the following detailed description is read with reference to certain embodiments, some of which are illustrated in the appended drawings in which like characters represent like parts throughout the drawings. It is to be noted, however, that the appended drawings illustrate only some embodiments and are therefore not to be considered limiting of its scope, and may admit to other equally effective embodiments.

FIG. 5A shows a cross-sectional view of a device according to some embodiments of the disclosure.

FIG. 5B shows a close-up cross-sectional view of a portion of the device according to some embodiments as shown in FIG. 5A.

FIG. 5C shows a close-up cross-sectional view of a portion of the device according to some embodiments as shown in FIG. 5A.

DETAILED DESCRIPTION

In the following description, numerous details are set forth to provide an understanding of the present disclosure. It will be understood by those skilled in the art, however, that the embodiments of the present disclosure may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and "downwardly", "upstream" and "downstream"; "above" and "below"; and other like terms indicating relative positions above or below a given point or element are used in this description to more clearly describe some embodiments of the disclosure.

Methods and apparatuses are disclosed herein for capturing fluids, often termed a "sample fluid" or "fluid sample," in a downhole well or other environments where the device would be useful. The term "sample fluid" or "fluid sample" is intended to encompass any portion of a body of fluid that is collected and/or desired to be collected. In the oil & gas industry, fluids having a hydrocarbon content that are found in a downhole environment may be sampled for further analysis. The fluids may include a liquid hydrocarbon content (such as oil) and a gas hydrocarbon content (such as methane). The downhole fluid sample may then be analyzed to determine, quantitatively and qualitatively, the chemical composition of the fluid. This data can help determine the formation characteristics and aid in formation evaluation to help plan further exploration and/or production operations. Fluid samples may be taken at various stages of oil & gas exploration and production, such as while drilling, during wireline operations, or well testing. Sampling while drilling sometimes is particularly difficult compared to sampling during wireline or well testing operations, in particular when a "single phase" sample is desired.

Figure 1:
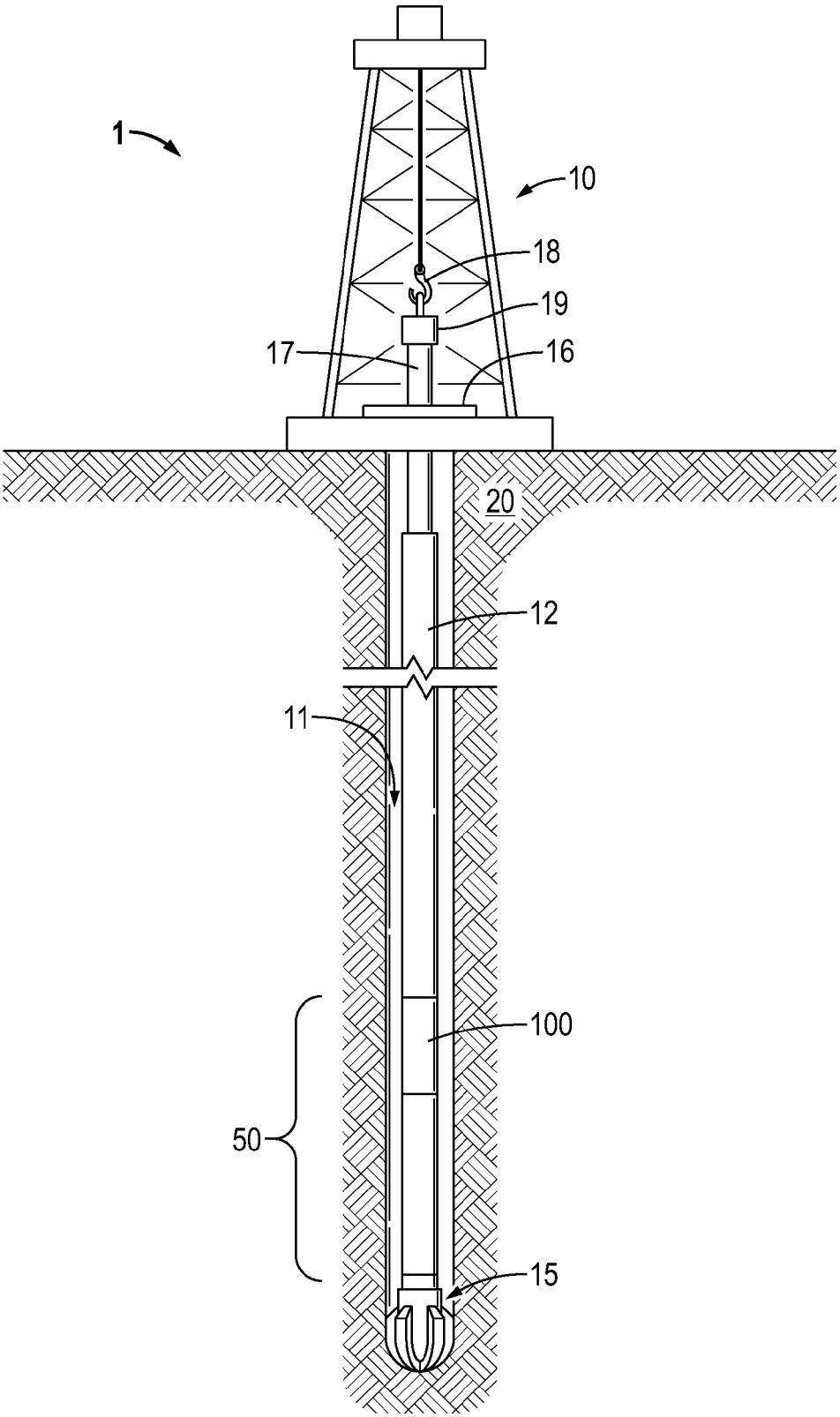
FIG. 1 shows a schematic view of a device according to some embodiments of the disclosure conveyed in a wellbore penetrating a formation for "sampling" a fluid downhole.

FIG. 1 depicts a well site 1 including a rig 10 with a drill string 12 suspended therefrom and into a wellbore 11. The drill string 12 has a drill bit 15 at its lower end that is used to advance the downhole tool into the formation 20 and form the wellbore 11. The drill string 12 may be rotated by a rotary table 16, energized by means not shown, which engages a kelly 17 at the upper end of the drillstring. The drillstring 12 is suspended form a hook 18, attached to a traveling block through the kelly 17 and a rotary swivel 19 which permits rotation of the drillstring relative to the hook. The rig 10 is depicted as a land-based platform and derrick assembly used to form the wellbore 11 by rotary drilling in a manner that is well known. Submersible, semi-submersible, and other types of drilling rigs may also be used for offshore exploration and production.

A bottom hole assembly ("BHA") 50 is positioned near the drill bit 15 (in other words, within several drill collar lengths from the drill bit). The BHA includes various components with capabilities, such as measuring, processing, and storing information, as well as communicating with the surface. A telemetry device (not shown) may also be provided for communicating with a surface unit (not shown). The BHA 50 may also include a downhole sampling tool 100 for obtaining a fluid sample of the fluid flowing from the subsurface formation 20. The tool 100 may be housed in a drill collar or other similar fluid communication module for performing various formation evaluation functions. The sampling tool 100 may be used on a sample carrier module during a sampling while drilling operation. The sample carrier may be equipped with multiple sampling tools 100, where each sampling operation is controlled independently with the activation of valves in flow lines of the modular carrier. The downhole sampling tool 100 may be positioned adjacent a sample carrier module having a probe with an inlet for receiving formation fluid. Additional devices, such as pumps, gauges, sensor, monitors or other devices usable in downhole sampling and/or testing may also be provided to direct formation fluid to the downhole sampling tool 100 for collection.

Figure 2A:
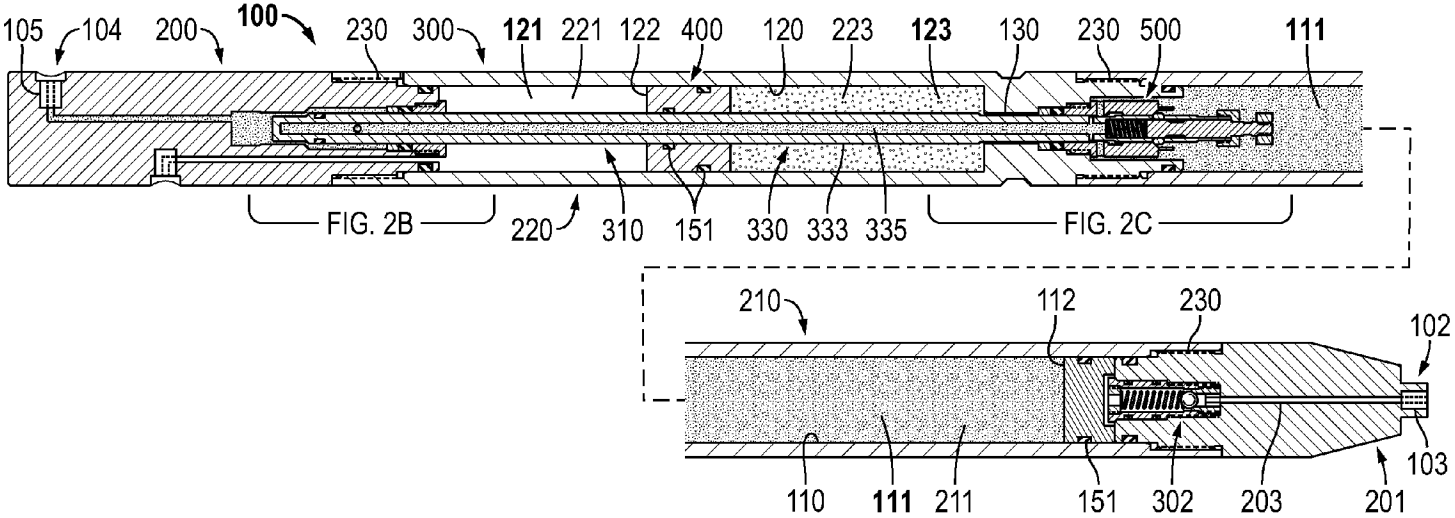
FIG. 2A shows a cross-sectional view of a device according to some embodiments of the disclosure.
Figure 2C:
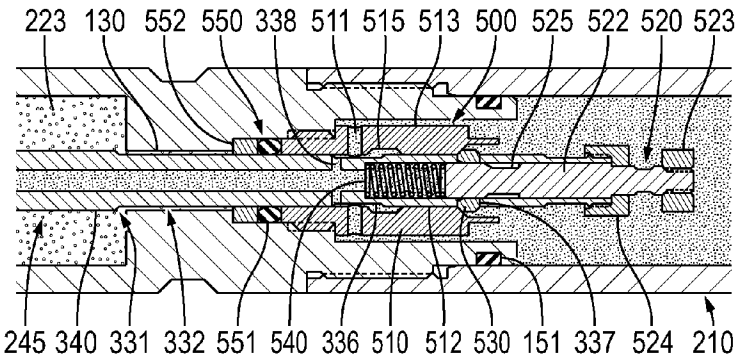
FIG. 2C shows a close-up cross-sectional view of a portion of the device according to some embodiments as shown in FIG. 2A.
Figure 2B:
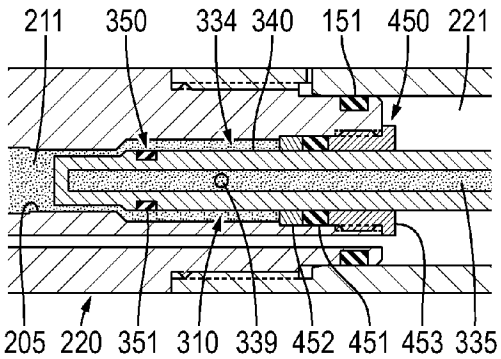
FIG. 2B shows a close-up cross-sectional view of a portion of the device according to some embodiments as shown in FIG. 2A.

FIG. 2A shows a cross-sectional view of the downhole sampling tool 100 for obtaining fluid from a subsurface formation 20 penetrated by a wellbore 11. FIGS. 2B and 2C each show a close-up of their corresponding respective portions of the sampling tool 100 shown in FIG. 2A. FIGS. 3A-7 also show cross-sectional views of the downhole sampling tool 100 in various stages of operation, including corresponding close-up views of various portions of the downhole tool 100. FIGS. 2A-2C show the sampling tool 100 in its pre-sampling state, primed with pressurized fluids, including gases and power fluids, in preparation for collecting fluid samples. The sampling tool 100 includes an inlet 102 and an outlet 104 for establishing fluid communication between the wellbore 11 and formation 20 and the downhole tool 100. The outlet 104 may include a cross-over 105, while the inlet 102 may have a valve 103 or other similar component to open and close fluid communication with the tool 100. The inlet 102 may also be connected with other pumps and devices that are either part of the module that houses the sampling tool 100 or located along other portions of the BHA to further aid in collecting fluid from the formation and directing it to the sampling tool 100.

Figure 3A:
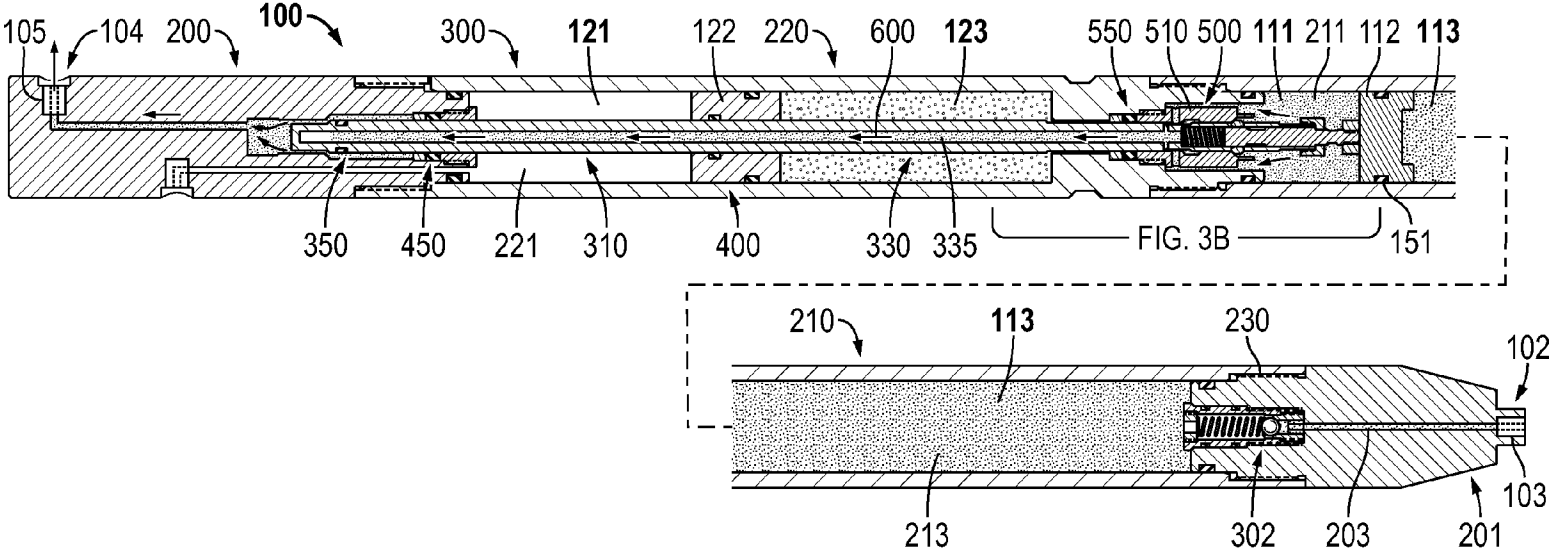
FIG. 3A shows a cross-sectional view of a device according to some embodiments of the disclosure.

The sampling tool 100 has a first chamber 110 fluidly communicating with the inlet 102 and a second chamber 120 fluidly communicating with the outlet 104. A first piston 112, movably disposed within the first chamber 110, divides the first chamber 110 to form a variable-volume buffer fluid compartment 111 and a variable-volume sample fluid compartment 113. FIG. 3A shows the variable-volume sample fluid compartment 113 as a fluid sample is extracted from the formation/wellbore 20, 11 and drawn or flown into the first chamber 110. A second piston 122, movably disposed within the second chamber 120, divides the second chamber 120 to form a variable-volume pressurized gas compartment 121 and a variable-volume power fluid compartment 123. The first and second pistons 112, 122 also have corresponding sealing elements 151 to prevent fluid leakage between the compartments. The first piston 112 may also have an agitation ring 114 partially surrounded by a sleeve 115 formed from plastic, such as PEEK. When the downhole sample tool 100 returns to the surface, the temperature of the fluid sample reduces to ambient and some waxes and asphaltenes may drop out of the solution. The agitation ring 114 may be used to help mix the fluid sample when heated again at the surface before transfer of the fluid sample out of the sample tool 100 for subsequent analysis. The plastic sleeve may protect the bore of the chamber from the harsh shock environment when drilling.

When the sampling tool 100 is primed and ready for collecting a fluid sample, buffer fluid 211 fills the buffer fluid compartment 111, pressurized gas 221 fills the variable-volume pressurized gas compartment 121, and pressurized fluid, such as a power fluid 223, fills the variable-volume power fluid compartment 123, as shown in FIGS. 2A-2C. The pressurized gas may comprise inert gases that are compressible, such as nitrogen. The power fluid may be various types of natural or synthetic motor oils and/or mineral oils. The buffer fluid may be the same type of fluid as the power fluid, i.e. various types of natural or synthetic motor oils and/or mineral oils. A sample of the formation fluid 213 fills up the variable-volume sample fluid compartment 113 during collection of the fluid selected for sampling, as shown in FIGS. 3-7.

The sampling tool 100 includes a self-closing system 300 and a pressure compensation system 400. The self-closing system 300 automatically halts fluid communication between the wellbore/formation 11, 20 and sampling tool 100 during a fluid sampling process. Fluid communication between the tool and the formation may be halted at least partially, such as permitting fluid to enter but no longer exit the tool, and then completely halted once a sufficient amount of sample fluid has been collected. The pressure compensation system 400 maintains the collected fluid in the same phase in which it was collected, sometimes referred to as a "single phase" fluid or sample. "Single phase" refers to a fluid sample stored in a sample chamber, and means that the pressure of the chamber is maintained or controlled to such an extent that sample constituents which are maintained in a solution through pressure, such as gasses and asphaltenes, should not separate out of solution as the sample cools upon retrieval of the tool 100 from a wellbore 11.

As shown in FIGS. 2A-7, the self-closing system 300 shuts-off fluid communication with the wellbore 11 and formation 20 by preventing fluid in the sampling tool 100 from flowing to the wellbore 11 and formation 20 via the inlet 102 or outlet 104. The self-closing system 300 includes a rod 330 to prevent fluid from exiting the tool through the outlet 104 when the rod 330 moves from a first position 310 (FIG. 2A-3B) to a second position 320 (FIG. 5A-7). As the self-closing system 300 halts fluid communication from the sampling tool 100 to the formation 20, a rod locking mechanism 500 activates the pressure compensation system 400 during collection of the fluid sample, such as by releasing the rod 330 from the first position 310 and securing it in the second position 320. The self-closing system 300 may also include the rod-locking mechanism 500 and a check-valve 302 to prevent collected fluid from returning to the formation 20 through the inlet 102.

The self-closing system 300 is enabled by a combination of the rod 330 biased in an axial direction and the rod-locking mechanism 500, which secures the rod 330 when in the first position 310 (FIGS. 2A-3B), releases the rod 330 allowing it to move between the first and a second position, i.e. the rod is in a transitory position 315 (FIGS. 4A-4B), and subsequently secures the rod 330 again when in the second position 320 (FIGS. 5A-5C). The self-closing system 300, pressure compensation system 400, and rod-locking mechanism 500 will be described subsequently in more detail.

Turning again to FIGS. 2A-2C, a first passageway 130, located between the first chamber 110 and the second chamber 120, fluidly communicates with the first chamber 110 and the second chamber 120. The rod 330, having a first end 332, a second end 334, and a shaft 333, controls and directs the flow of the various fluids in the sampling tool 100 to the different chambers and compartments within the sampling tool 100, and even to the wellbore 11 and formation 20 at certain stages of operation. The rod 330 also includes a second passageway 335 formed within it.

The rod 330 passes through the second piston 122 and is movably disposed within the first chamber 110, the second chamber 120, and the first passageway 130. The rod 330 also axially traverses the length of the second chamber 120. In some embodiments, the rod does not traverse the length of first chamber 120, as shown in the FIGS. As previously discussed, the rod 330 is movable between a first position 310 (FIGS. 2A-3B) and a second position 320 (FIGS. 5A-7). When the rod 330 is in the first position 310, the second passageway 335 fluidly communicates with the first chamber 110 and the outlet 104. When the rod 330 is in the second position 320, the first passageway 130 and the second passageway 335 fluidly communicate with the first chamber 110 and the second chamber 120.

The rod 330 is adapted to be biased in an axial direction when subjected to a pressurized fluid within the second chamber 123, such as power fluid 223. In other words, the rod 330 will be biased towards one end of the sampling tool 100 during operation of the sampling tool 100. This bias may be deemed a passive bias as no mechanical or other type of device, such as a spring, actively biases the rod 330 in a chosen direction. Rather the rod 330 becomes biased in an axial direction when housed in a pressurized chamber, such as the second chamber 120, that it is filled with pressurized fluid, such as power fluid 223.

In one example of priming the sampling tool 100, pressurized gas 221 fills up the pressurized gas chamber 121 and power fluid 223 fills up the pressurized fluid chamber 123 to a desired pressure that is greater than the pressure of the pressurized gas 221. The power fluid 223 displaces the second piston 122 to compress and further pressurize the pressurized gas 221. Both compartments 121, 123 may be pressurized from 5000 psi to 25,000 psi, such as 20,000 psi. Other methods and sequences of operation for priming the sampling tool 100 will be recognized by persons of ordinary skill in the art.

The rod 330 may be adapted to be passively biased towards an end of the sampling tool by providing a stepped diameter 331 located along a portion of the shaft 333 that is within the second chamber 120 or the passageway 130, as shown in FIG. 2C. The difference in diameters forming the stepped diameter 331 may be as much as 0.300 inches or as little as 0.010 inches. The difference in diameters should be sufficient to cause the rod 330 to be biased in one direction and provide enough force to move the rod 330 into a position to stop fluid communication into or out of the tool 100 as may be desired. FIGS. 2A-3B show the rod 330 biased in a direction that will stop fluid communication with the tool outlet 104, preventing buffer fluid 211 from exiting the outlet 104. The pressurized gas creates a force differential on the area of the rod 330 corresponding to the stepped diameter 331.

The portion of the shaft 333 having an increased diameter results in more force being applied by the pressurized fluid to that area of the shaft 333 when compared to the amount of force being applied to the area of the shaft 333 corresponding to the smaller diameter. The resulting force differential biases the rod 330 in the direction of increased force. For example, if the difference in diameters along the rod 330 results in the shaft 333 having a large area equal to 0.250 $in^2$ and a small area equal to 0.200 $in^2$, the resulting force differential between the large and small areas under 20,000 psi of pressurized fluid is about 1000 $lbs_f$. Assuming the stepped diameter 331 resulted in a large area and small area as in the example provided, that means about 1000 $lbs_f$ difference will cause the rod 330 to be biased towards the outlet 104, as shown in FIG. 2A-3B. In some embodiments, the amount of force used to bias and move the rod 330 to the second position to close fluid communication between the first chamber 110 and the outlet 104 may be from 100 $lbs_f$ to 2,000 $lbs_f$.

In some embodiments, the sampling tool 100 may be formed by coupling together two or more separate sub-components. Turning again to FIGS. 2A-2C, two sub-housings, such as an upper sub-housing 210 and a lower sub-housing 220, both of which may comprise a generally cylindrical, hollow body, are coupled together using a threaded or other type of connection means 230. The first passageway 130 may be formed in a portion of the lower sub-housing 220 adjacent the connection means 230 or generally proximate the upper sub-housing 210, such that when the sub-housings 210, 220 are coupled together, the first passageway 130 fluidly couples the second chamber 120 with the first chamber 110. In some embodiments, the first passageway 130 may be formed in a portion of the first sub-housing 210 that is adjacent to or generally proximate the lower sub-housing 220 when the sub-housings 210, 220 are coupled together. One or more sealing elements 151 may also prevent fluid leakage between the sub-components.

The sub-components may also include a valve manifold assembly 201, positioned adjacent the first chamber 110 and coupled, threadably or otherwise, with the upper sub-housing 210. Together, the valve manifold assembly 201, the upper sub-housing 210, and the lower sub-housing 220 may form the first chamber 110. In other words, the first chamber 110 may be defined by the interior walls of the upper sub-housing 210, the valve manifold assembly 201, and the lower sub-housing 220. The valve manifold assembly 201 fluidly communicates with the inlet 102 and the first chamber 110. The inlet 110 may be formed in the valve manifold 201. A check valve 302 for preventing fluid in the sample fluid compartment 113 from flowing back to the formation 20 through the inlet 102 may be housed within the valve manifold assembly 201. Additionally, multiple types of valves 202 may be housed within the manifold assembly 201, such as check valves, bleed valves, transfer valves, manual valves, etc. The valve manifold assembly 201 may also include various ports 203 to provide fluid access to the sampling tool 100.

The sub-components may also include a lower fixing head 200, positioned adjacent the second chamber 120 and coupled, threadably or otherwise, with the lower sub-housing 220. Together, the lower fixing head 200, the lower sub-housing 220, and the upper sub-housing 210 may form the second chamber 120. In other words, the second chamber 120 may be defined by the interior walls of the lower sub-housing 220, the lower fixing head 200, and the upper sub-housing 210. A cavity 205 may be formed in the lower fixing head 200 that fluidly communicates with the outlet 104 and the second passageway 335. In some embodiments, the cavity 205 may have a shape that exhibits a change in diameter, either in a step-wise fashion, such as a counter bore type shape shown in the FIGS., or in a continuous decrease/increasing diameter, such as a truncated cone. In some embodiments, the second end of the rod 334 is disposed within the cavity 205.

The rod-locking mechanism 500, disposed proximate the first end 332 of the rod 330 and within the first chamber 110, secures the rod 330 when it is in the first position 310 (FIGS. 2A-3B), releases the rod 330 when it is in the transitory position 315, moving between the first position 310 and the second position 320 (FIGS. 4A-4B), and secures the rod 330 when it is in the second position (FIGS. 5A-7). In some embodiments, neither the rod 330 nor the rod-locking mechanism 500 is mechanically connected with the first piston 112 or with the valve manifold assembly 201 of the downhole sampling tool 100. The rod-locking mechanism 500 also activates the pressure compensation system 400 in order to maintain fluid captured in the first chamber at pressurized conditions, i.e. it maintains the formation fluid sample 213 in a "single phase", as shown in FIGS. 5A-7. The rod-locking mechanism 500 activates the pressure compensation system 400 in the downhole sampling tool 100 by releasing the rod 330 from the first position 310 so that the rod 330 can move into the second position 320.

Turning again to FIG. 2C, the rod-locking mechanism 500 is shown in more detail. In some embodiments, the rod-locking mechanism 500 includes an annular housing 510, a lock-pin 520, a rod-lock key 530, and a biasing element, such as a spring 540, each of which may be disposed in the first chamber 110. The annular housing 510 may be proximate the first passageway 130 and the first end 332 of the rod 330. The annular housing 510 surrounds the rod 330 and has an interior recess 515 along its interior surface 512. An annular housing passageway 511 connects the annular housing interior surface 512 with its exterior surface 513.

The lock pin 520 has a shaft 522 that is disposed, at least partially, and movable within the second passageway 335 of the rod 330. The lock pin 520 axially extends from the rod 330 beyond the first end 332. In some embodiments, the lock pin 520 may extend beyond the annular housing 510. The lock pin 520 also has an exterior recess 525 located along the exterior of its shaft 522. A stop 523 may also be coupled to and located at the end of the lock pin 520 opposite the portion of its shaft 522 that is within the second passageway 335. An end cap 524 may be coupled to the rod first end 332 in order to retain the lock pin 520 within the second passageway 335.

The rod-lock key 530 is at least partially disposed in one or more rod slots 337 and supported by the lock pin shaft 522. The rod-lock key 530 may comprise two halves of a ring that are disposed in the one or more rod slots 337. The rod-lock key 503 rests on the lock pin shaft 522 when the rod-lock key 503 extends from the rod 330. When retracted into the rod slots 337, the rod-lock key 503 rests on the exterior recess 525 of shaft 522. The biasing element, such as a spring 540, is disposed within the second passageway 335, and biases the lock pin 520 in a direction that causes the rod-lock key 530 to extend and secure the rod 330 in place when in the first position 310 or the second position 320.

The rod-lock key 530 abuts the annular housing 510 to secure the rod 330 when the rod 330 is in the first position 310 (FIGS. 2A-3B), preventing the rod 330 from moving to the second position 320 due to its bias as previously discussed. As shown in FIG. 4B, the rod-lock key 530 retracts when disposed in the exterior recess 525 of the lock pin 520.

In the retracted state, the outer diameter 534 of the rod-lock key 530 is less than the inner diameter 514 of the annular housing 510, thereby releasing the rod 330 from the first position 310 so that it automatically moves in the biased direction between the first and second positions 310, 320. When the rod 330 is in the second position 320 as shown in FIGS. 5A-5C, the rod-lock key 530 abuts and/or is positioned within the interior recess 515 of the annular housing 510, securing the rod in the second position 320.

Turning back to FIGS. 2C and 5C showing the first end 332 of the rod 330 when in the first position 310 and the second position 320 respectively, the downhole sampling tool 100 also includes a first sealing mechanism 550 surrounding and proximate to the first end 332 of the rod 330, and disposed within and/or adjacent to the first passageway 130. In some embodiments the first chamber 110 may also be defined by a portion of the second sealing mechanism 550. The first sealing mechanism 550 is also located proximate to but does not surround a relief diameter 336 formed along a portion of the shaft 333, when the rod 330 is in the first position 310. The relief diameter 336 has a first opening 338 that fluidly communicates with the rod's exterior surface 340 and the second passageway 335. The first sealing mechanism 550 may include one or more sealing elements 551 and a back-up ring 552. The annular housing 510 may also function as a retainer for the first sealing mechanism 550 and the one or more sealing elements 551.

FIGS. 2B and 5B show the second end 334 of the rod 330 when in the first position 310 and the second position 320 respectively. A second sealing mechanism 350 surrounding and proximate to the second end 334 of the rod 330 is disposed within or adjacent to the cavity 205. The second sealing mechanism 350 may include one or more sealing elements 351 that surround the second end 334.

A third sealing mechanism 450 may be positioned between the cavity 205 and the pressurized gas compartment 121 to prevent fluid leakage between the cavity 205 and pressurized gas compartment 121. In some embodiments, the second chamber 120 may also be defined by a portion of the third sealing mechanism 450. The third sealing mechanism 450, which may be similar to the first sealing mechanism 550, includes one or more sealing elements 451, a back-up ring 452, and a retainer 453.

The second end 334 of the rod 330 has a second opening 339 positioned along the rod 330 between the one or more sealing elements 351 and the second chamber 120 and/or between the one or more sealing elements 351 and the third sealing mechanism 450. The second opening 339 fluidly communicates between the second passageway 335 and the rod's exterior surface 340 and the cavity 205.

As shown in FIG. 2B-3B, the first sealing mechanism 550 prevents fluid in the second chamber 123 from entering the first chamber 110 through first passageway 130 while the second sealing mechanism 350 permits fluids from the first chamber 110 to enter the cavity 205 via the second passageway 335 and exit through the outlet 104 to the wellbore 11 and formation 20. When in the first position 310, the sealing elements 351 do not seal the space between the second end 334 and the cavity 205, thereby permitting fluid to flow from the second passageway 335 through the second opening 339 into the cavity 205 and exiting the outlet 104. Thus, when the rod 330 is in the first position 310, a first fluid pathway 600 is formed from the first chamber 110, through the annular housing passageway 511 and the first opening 338, into the second passageway 335, and to the outlet 104. The first fluid pathway 600 establishes fluid communication between the first chamber 110 and the wellbore/formation 11, 20.

Turning to FIGS. 5A-5C, the first sealing mechanism 550 now surrounds the relief diameter 336 and the sealing elements 351 seal the space between the rod's second end 334 and the cavity 205. The first sealing mechanism 550 permits fluid in the second chamber 120 to flow around the sealing mechanism 550 and enter the first chamber 110 through the first passageway 130 (FIG. 5C). The second sealing mechanism 350 permits fluids from the second chamber 120 to enter the cavity 205 through the second passageway 335 but prevents fluid from exiting through the outlet 104 to the wellbore 11 and formation 20 (FIG. 5B). In other words, the second sealing mechanism 350 prevents fluid from the second passageway 335 from flowing through the second opening 339, into the cavity 205, and exiting outlet 104. Thus, the rod's movement to the second position 320 forms a second fluid pathway 700 from the second chamber 120 through the first passageway 130, past the first sealing mechanism 550 and relief diameter 336, into the first chamber 110, through the first opening 338, and into the second passageway 335 and the cavity 205. In some embodiments, the fluid pathway 700 may also include the annular housing passageway 511. The second fluid pathway 700 establishes fluid communication between the first chamber 110, the second chamber 120, and the cavity 205, but not the wellbore/formation 11, 20.

In some embodiments, a portion of the rod has a relief diameter and a first opening formed along the relief diameter, the first opening fluidly communicating with the rod's exterior surface and the second passageway. The annular housing may also have an annular housing passageway connecting the interior surface with its exterior surface, such that when the rod is in the first position, a first fluid path is formed from the first chamber through the annular housing passageway and the first opening, into the second passageway, and to the outlet, and such that when the rod is in the second position, the first sealing mechanism is positioned proximate the relief diameter thereby forming a second fluid path from the second chamber through the first passageway past the first sealing mechanism and relief diameter, into the first chamber, through the first opening, and into the second passageway.

The downhole sampling tool may also have a valve manifold assembly positioned adjacent the first chamber and fluidly communicating with the inlet and the first chamber, the valve manifold assembly having a check valve for preventing fluid in the first chamber from flowing to the formation through the inlet and a lower fixing head positioned adjacent the second chamber, the lower fixing head having a cavity fluidly communicating with the outlet and the second passageway, wherein the second end of the rod is disposed within the cavity.

In some embodiments, the downhole sampling includes a second sealing mechanism disposed within or adjacent to the cavity, the second sealing mechanism having one or more sealing elements, such that when the rod is in the first position, the second sealing mechanism permits fluid from the first chamber to enter the cavity through the second passageway and exit through the outlet to the wellbore and/or formation and, when the rod is in the second position, the second sealing mechanism permits fluid from the second chamber to enter the cavity through the second passageway but prevents fluid from exiting through the outlet to the wellbore/formation.

In some embodiments of the downhole sampling tool, the second end of the rod has a second opening positioned along the rod between the second sealing mechanism and the second chamber where the second opening fluidly communicates with the rod's exterior surface and the cavity. When the rod is in the first position, the one or more sealing elements do not seal the space between the second end of the rod and the cavity, thereby permitting fluid flowing from the second passageway through the second opening into the cavity and to the outlet. And when the rod is in the second position, the one or more sealing elements seal the space between the second end of the rod and the cavity, preventing fluid from flowing to the outlet from the second passageway through the second opening into the cavity.

A method of obtaining a sample of fluid from a subsurface formation 20 penetrated by a wellbore 11 will now be discussed referring to the FIGS. Turning to FIG. 1, the method may include positioning a downhole sampling tool 100 within the wellbore 11. As shown in FIGS. 2A-2C, the downhole tool 100 has an inlet 102 and an outlet 104 for establishing fluid communication between the wellbore/formation 11, 20 and the downhole tool 100. The downhole sampling tool 100 is initially primed with pressurized gas 221, such as nitrogen, and power fluid 223 that are both charged to a desired pressure, such as around 20,000 psi. Buffer fluid fills the buffer fluid compartment 111, which will be open to the wellbore pressure, thus keeping the first piston next to the valve manifold assembly 201 as the downhole sample tool 100 descends into the wellbore 11 and the pressure of the wellbore 11 and buffer fluid compartment 111 increases.

Figure 3B:
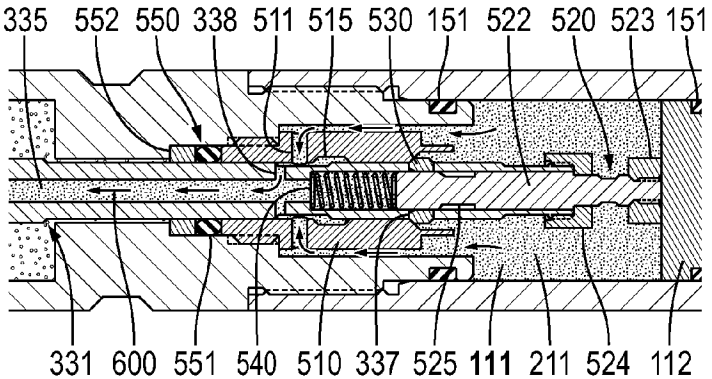
FIG. 3B shows a close-up cross-sectional view of a portion of the device according to some embodiments as shown in FIG. 3A.
Figure 4A:
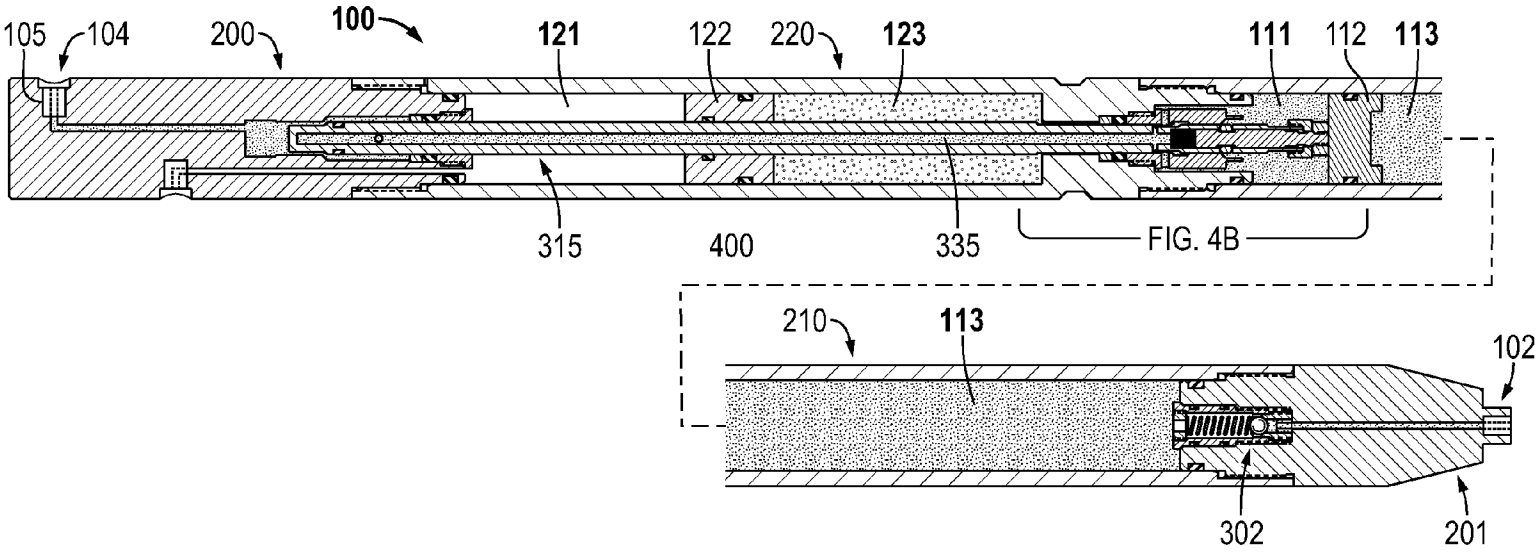
FIG. 4A shows a cross-sectional view of a device according to some embodiments of the disclosure.
Figure 4B:
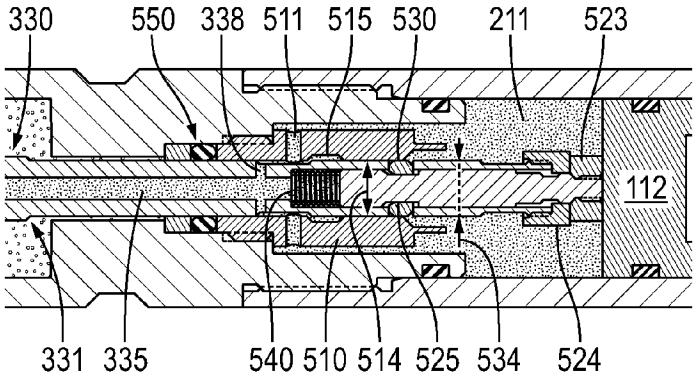
FIG. 4B shows a close-up cross-sectional view of a portion of the device according to some embodiments as shown in FIG. 4A.

Turning to FIGS. 3A-3B, upon commencement of a process for obtaining a fluid sample from a downhole formation 11, formation fluid 213 flows into the sample fluid compartment 113 through the inlet 104 in order to collect the formation fluid 213. As the variable-volume sample fluid compartment 113 increases in volume, the first piston 112 moves towards the rod-locking mechanism 500 that secures the rod 330 in the first position 310 while expelling buffer fluid 211 in the variable-volume buffer fluid compartment 111 through the second passageway 335 and out the outlet 104 to the wellbore 11, as shown in FIGS. 3A-4A.

The formation fluid 213 may be pumped into the sample fluid compartment 113 using a pump or other similar devices that are part of the carrier module and/or the BHA 50. In some embodiments, the pump will flow the formation fluid 213 to the sample fluid compartment 113 at a pressure above the wellbore 11 fluid pressure, sometimes referred to as an overpressure. The overpressure may be from 50 psi to 2,000 psi above the wellbore fluid pressure, such as 100 psi.

FIGS. 4A-5C show that as more formation fluid 213 enters the sample fluid compartment 113 past the check valve 302, the first piston 112 moves towards and eventually actuates the rod-locking mechanism 500, causing the rod-locking mechanism 500 to disengage the rod 330 and release it from the first position 310. At the end of the first piston stroke, the first piston 112 pushes on the lock pin 520 of the rod-locking mechanism 500 to disengage the rod-lock key 530 abutting the annular housing 510 that surrounds the rod 330, as shown in FIG. 4B. As the shaft 522 supporting the rod-lock key 530 moves further into the second passageway 335 of the rod 330, the rod-lock key 530 drops into and is now supported by the exterior recess 525 located along the shaft 522. The rod-lock key 530 diameter 534 decreases until the diameter 534 is less than the annular housing 510 inner diameter 514, thereby releasing the rod 330 from the rod-locking mechanism 500 (FIG. 4B). As the rod 330 now moves towards its biased direction, the rod-lock key 530 travels through the inner portion of the annular housing 510.

The formation fluid 213 flows to the sample fluid compartment 113 at an overpressure sufficient to activate the locking mechanism 500. The formation fluid overpressure enables the incoming flow of formation fluid 213 to overcome the force of the spring keeping the check valve 302 closed, the force of the seal friction of the first piston 112 preventing the first piston 112 from being displaced, and the force of the biasing element, such as spring 540, in the locking mechanism 500 keeping the rod-lock key 530 extended.

Once the rod 330 is released, it then moves to the second position 320 due to the pressurized fluid causing a differential force to be exerted in the area of the stepped diameter 331. In the embodiments shown, the rod 330 is biased in the direction that would close fluid communication between the outlet 104 and the first chamber 110. The power fluid 223 charge pressure provides sufficient force on the rod 330 to move it from the first position 310 to the second position 330.

In other words, the power fluid 223 in the power fluid compartment 123 biases the rod 330 towards the second position 320. In this manner, the passively biased rod 330 moves automatically towards the second position 320 due to the bias created from the power fluid 223 on the rod 330. In some embodiments, the amount of force used to bias and move the rod 330 to the second position may be from 100 $lbs_f$ to 2000 $lbs_f$ and provided with a power fluid 223 charge pressure from 5000 psi to 25,000 psi, such as 20,000 psi.

Figure 6A:
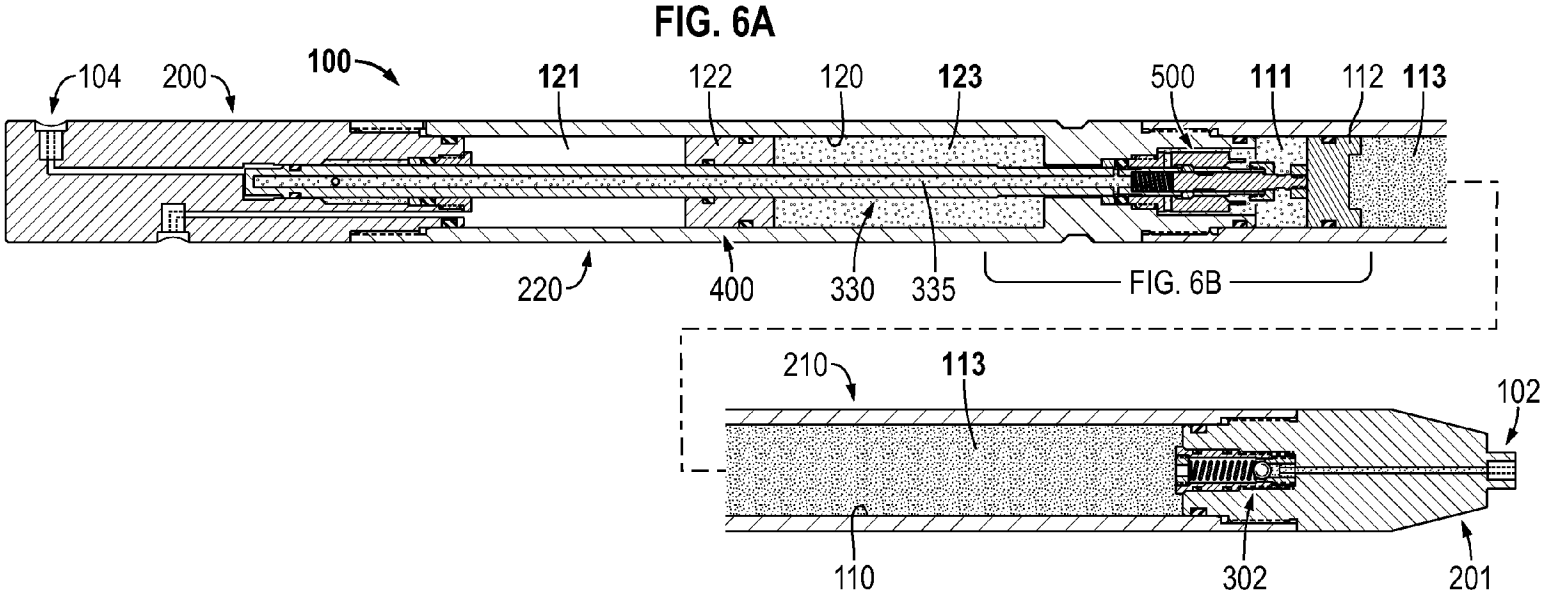
FIG. 6A shows a cross-sectional view of a device according to some embodiments of the disclosure.
Figure 6B:
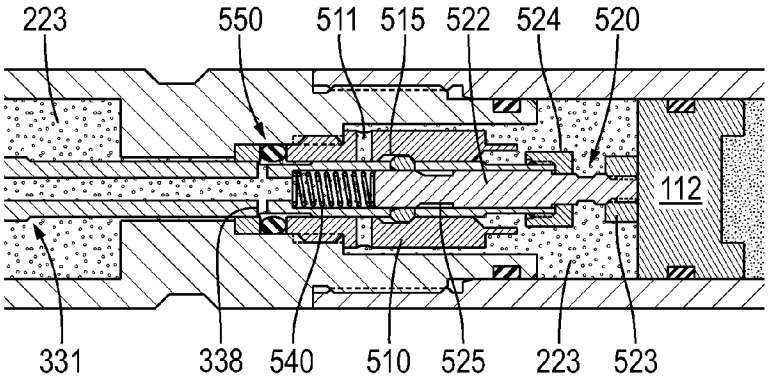
FIG. 6B shows a close-up cross-sectional view of a portion of the device according to some embodiments as shown in FIG. 6A.

As the rod 330 moves into the second position 320, the rod 330, the lock pin 520, and the rod-lock key 530 move into the annular housing 510 interior until the rod-lock key 530 aligns with the interior recess 515 formed along the interior surface 512 of the annular housing 510, as shown in FIG. 5C. As the rod 330 moves towards the second position 320, the biasing element, such as the spring 540, is compressed until the rod 330 reaches the second position 320. When the rod 330 reaches the second position 320, the biasing element, such as the spring 540, pushes the lock pin 520 away from the biasing element causing the rod-lock key 530 to re-extend to its original diameter and, while being supported along the lock pin shaft 522, to abut the interior recess 515 of the annular housing 510, as shown in FIG. 6B. Thus, the rod-locking mechanism 500 reengages the rod 330 to secure it in the second position 320.

The pressure compensation system 400 may be activated by moving the rod 330 from the first position 310 to the second position 320. Once in the second position 320, the first sealing mechanism 550, now positioned proximate the relief diameter 336, disengages the rod 330, allowing the pressurized power fluid 223 in the power fluid compartment 123 to flow to the buffer fluid compartment 111 through the first passageway 130, as shown in FIG. 5C. In some embodiments, the first sealing mechanism 550 may disengage the rod 330 before it reaches the second position 320. Then, the power fluid 223 flows through the first passageway 130 to the variable-volume buffer fluid chamber 111 forcing the buffer fluid 211 to exit the sampling tool 100 through the second passageway 335, cavity 205, and outlet 104 until fluid communication between the buffer fluid compartment 111 and the formation 20 is closed when the rod reaches the second position 320.

As the rod 330 moves into the second position 320, the one or more seals 351 are inserted inside at least a portion of the cavity 205 and engage the surface of cavity 205 to prevent fluid communication between the cavity 205 and the outlet 104. The pressurized power fluid 223 continues to flow into the buffer fluid compartment 111, through the first opening 338, the second passageway 335, the second opening 339, and into the portion of the cavity 205 between the third sealing mechanism 450 and the one or more seals 351 of the second sealing mechanism 350, filling up at least part the cavity 205.

Figure 7:
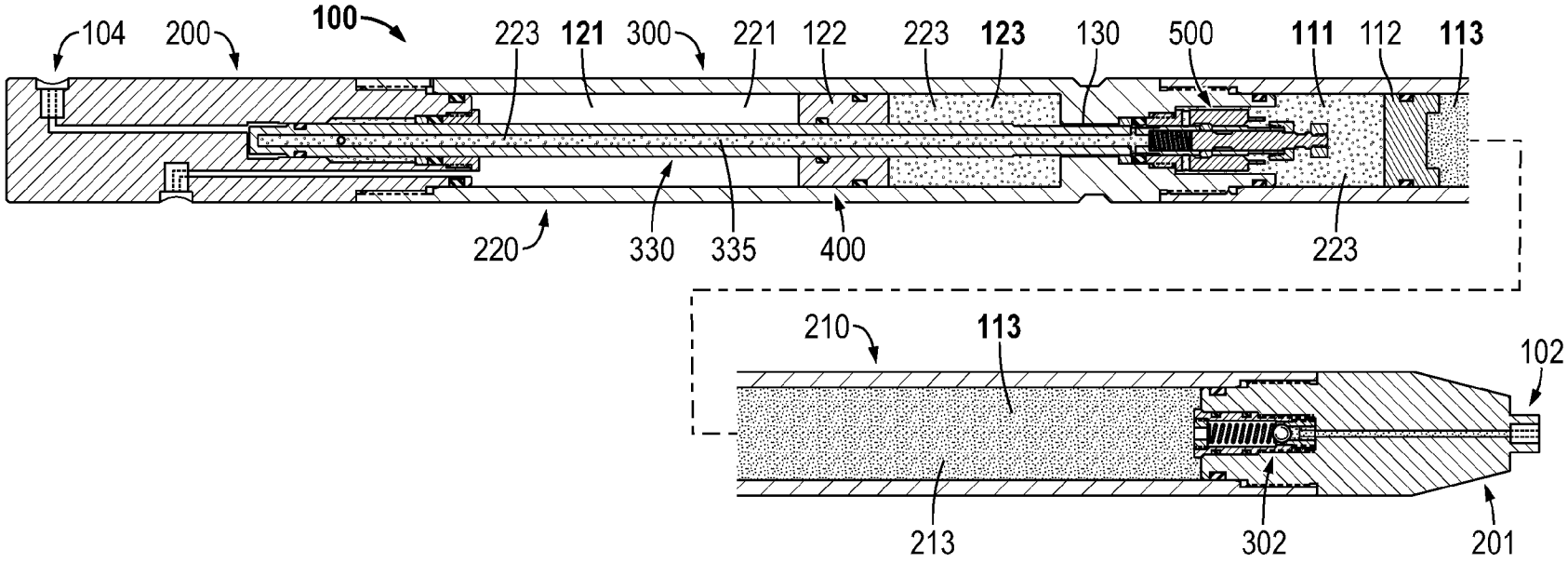
FIG. 7 shows a close-up cross-sectional view of a portion of the device according to some embodiments of the disclosure.

Fluid communication between the buffer fluid compartment 111 and the wellbore/formation 11, 20 ceases when the rod 330 reaches the second position 320, as shown in FIGS. 5A-5C. The second piston 122, via the resultant force generated by the pressurized gas 221 in the variable-volume pressurized gas compartment 121, moves in a direction that decreases the volume of the pressurized fluid compartment 123, thereby further pressurizing the power fluid 223, as shown in FIGS. 6A-7. The first piston 112, via means of the pressurized power fluid in the buffer fluid compartment 111, moves in a direction that decreases the volume of the sample fluid compartment 113, thereby pressurizing the formation fluid 213, as shown in FIG. 7. The check valve 302 prevents the collected formation fluid 213 in the sample fluid compartment 113 from flowing back to the wellbore/formation 11, 20 through the inlet 102.

Accordingly, activating the pressure compensation system 400 may include flowing pressurized fluid, such as power fluid 223, in the variable-volume power fluid compartment 123 to the buffer fluid compartment 111 though the first passageway 130 and closing fluid communication between the buffer fluid compartment 111 and the formation 20, as shown in FIGS. 4A-5C. Power fluid 223 flows through the first passageway 130 to the variable-volume buffer fluid chamber 111, through the second passageway 335 and into cavity 205, as shown in FIGS. 5A-5C. The pressurized gas 221 moves the second piston 122, decreasing the volume of pressurized fluid compartment, thereby further pressurizing the power fluid 223, as shown in FIGS. 6A-7. The power fluid 223 moves the first piston 112, decreasing the volume of the sample fluid compartment 113, thereby pressurizing the formation fluid 213, as shown in FIG. 7.

Thus, movement of the rod 330 activates the pressure compensation system 400 in order to maintain the formation fluid 213 in the sample fluid compartment 113 in substantially the same phase as it was found in the formation 20. The sampled formation fluid 213 thereby remains in a "single phase" state even when the sampling tool 100 is extracted from the wellbore 11.

As previously discussed and shown, activating the self-closing system 300 and the pressure compensation system 400 happens automatically and almost simultaneously as the formation fluid is collected, which collection of formation fluid eventually causes the rod-locking mechanism 500 to disengage the rod 330 thereby activating the systems 300, 400. The automatic actuation of the systems is enabled at least in part by the rod-locking mechanism 500 which provides the ability to automatically lock the rod 330 in two positions at different stages of operation. Thus, the rod-locking mechanism 500 in combination with the pressure compensation system 400 and self-closing system 300 ensure that the sample tool 100 will not prematurely close during the descent into the wellbore or any time before capturing a sample as per field operators command, and that the sampling tool 100 will not re-open after the sample has been captured.

A device 100 for collecting fluid has been shown and described. The device includes a self-closing system 300 that automatically halts fluid collection once a sufficient amount of fluid has been collected and a locking mechanism 500 that automatically activates a pressure compensation system 400 in order to maintain the collected fluid in the same phase in which it was collected. The self-closing and pressure compensation systems 300, 400 may include overlapping elements that may be considered a part of either system or even both systems. Those elements may include the check valve 302 in the valve manifold assembly 201, the rod-locking mechanism 500 and the rod 330 moving from the first position 310 to the second position 320 to close off fluid communication to the formation 20 through the outlet 104, pressurized gas 221 moving the second piston 122 to compress the power fluid 223, and moving the first piston 112 in order to compress the sampled formation fluid 213.

Although the preceding description has been described herein with reference to particular means, materials and embodiments, it is not intended to be limited to the particulars disclosed herein; rather, it extends to all functionally equivalent structures, methods, and uses, such as are within the scope of the appended claims.

The invention claimed is:

1. A downhole sampling tool for obtaining fluid from a subsurface formation penetrated by a wellbore, comprising:

an inlet and an outlet for establishing fluid communication between the formation and the downhole tool;

a first piston movably disposed within a first chamber, the first chamber fluidly communicating with the inlet;

a second piston movably disposed within a second chamber;

a first passageway fluidly communicating with the first chamber and the second chamber; and a rod having a first end, a second end, and a shaft, the rod passing through the second piston and movably disposed within the first chamber, the second chamber, and the first passageway, wherein the rod is adapted to be biased in an axial direction when subjected to a pressurized fluid within the second chamber.

2. The downhole sampling tool of claim 1, wherein a portion of the rod within the second chamber or the first passageway has a stepped diameter.

3. The downhole sampling tool of claim 1, wherein the rod axially traverses the length of the second chamber but not the first chamber.

4. The downhole sampling tool of claim 1, wherein the rod is movable between a first position and a second position, the rod having a second passageway formed within the rod, such that when the rod is in the first position, the second passageway fluidly communicates with the first chamber and the outlet, and when the rod is in the second position, the first and second passageways fluidly communicate with the first chamber and the second chamber.

5. The downhole sampling tool of claim 4, wherein the rod further comprises:

a rod-locking mechanism disposed proximate the first end of the rod and within the first chamber, the rod-locking mechanism adapted to secure the rod when in the first position, to release the rod when moving between the first and the second positions, and to secure the rod when in the second position.

6. The downhole sampling tool of claim 5, wherein the rod-locking mechanism is adapted to activate a pressure compensation system within the downhole sampling tool in order to maintain fluid captured in the first chamber at pressurized conditions.

7. The downhole sampling tool of claim 5, wherein the rod-locking mechanism comprises:

an annular housing disposed in the first chamber and proximate the first end and the first passageway, the annular housing surrounding the rod and having an interior recess along its interior surface;

a lock pin having a shaft movably disposed at least partially within the second passageway of the rod and axially extending from the rod, the lock pin having an exterior recess along the shaft;

a rod-lock key at least partially disposed in a rod slot and supported by the lock pin shaft;

a biasing element disposed within the second passageway and biasing the lock pin such that the rod-lock key secures the rod when in the first position or the second position.

8. The downhole sampling tool of claim 7, wherein the rod-lock key abuts the annular housing to secure the rod when in the first position;

wherein the rod-lock key is positioned within the interior recess of the annular housing when the rod is in the second position; and wherein the rod-lock key is disposed in the exterior recess of the lock pin such that the rod-lock key outer diameter is less than the annular housing inner diameter thereby releasing the rod when moving between the first and second positions.

9. The downhole sampling tool of claim 7, further comprising:

a first sealing mechanism proximate to and surrounding the first end of the rod and disposed within or adjacent to the first passageway, the first sealing mechanism preventing fluid in the second chamber from entering the first chamber through first passageway when the rod is in the first position and, when the rod is in the second position, permitting fluid in the second chamber to enter the first chamber through the first passageway.

10. The downhole sampling tool of claim 1, wherein the first piston actuates the rod-locking mechanism to release the rod and move the rod from the first position to the second position.

11. A method of obtaining a sample of fluid from a subsurface formation penetrated by a wellbore, comprising:

positioning a downhole sampling tool within the wellbore, the downhole sampling tool comprising:

an inlet and an outlet for establishing fluid communication between the formation and the downhole tool;

a first chamber divided by a first piston into a variable-volume buffer fluid compartment and a variable-volume sample fluid compartment;

a second chamber divided by a second piston into a variable-volume pressurized gas compartment and a variable-volume power fluid compartment; and a rod having a first end, a second end, and a shaft, the rod passing through the second piston and movably disposed within the first chamber, the second chamber, and a first passageway fluidly communicating with the first chamber and the second chamber, wherein the rod is biased towards the second chamber;

collecting formation fluid by flowing formation fluid into the sample fluid compartment through the inlet;

expelling buffer fluid in the buffer fluid compartment to the wellbore through a second passageway formed within the rod and the outlet; and activating a pressure compensation system with the rod in order to maintain the collected formation fluid in the sample fluid compartment in the same phase as in the formation.

12. The method of claim 11, wherein activating the pressure compensation system comprises:

flowing pressurized fluid in the power fluid compartment to the buffer fluid compartment though the first passageway;

ceasing fluid communication between the buffer fluid compartment and the formation;

further pressurizing the pressurized fluid by moving, via means of the pressurized gas, the second piston in a direction that decreases the volume of the pressurized fluid compartment; and pressurizing the formation fluid by moving, via means of the pressurized power fluid, the first piston in a direction that decreases the volume of the sample fluid compartment.

13. The method of claim 12, wherein the pressure compensation system is activated by moving the rod from a first position to a second position.

14. The method of claim 13, wherein the rod moves from a first position to a second position at 100 psi or less of closing pressure.

15. The method of claim 13, further comprising:

biasing the rod towards the second position such that the rod automatically moves to the second position when released by a rod-locking mechanism, wherein the pressurized fluid in the power fluid compartment biases the rod towards the second position.

16. The method of claim 15, wherein moving the rod from the first position to the second position comprises:

releasing the rod from the first position by disengaging a rod-locking mechanism that secures the rod in the first position;

moving the rod to the second position by means of the bias created from the pressurized fluid on the rod; and securing the rod in the second position by reengaging the rod-locking mechanism when the rod is in the second position.

17. The method of claim 16, wherein disengaging the rod-locking mechanism comprises:

moving the first piston towards the rod-locking mechanism while flowing formation fluid into the sample fluid compartment;

pushing on a lock pin of the rod-locking mechanism with the first piston to disengage a rod-lock key abutting an annular housing disposed within the buffer fluid compartment and surrounding the rod, the lock pin at least partially disposed within the second passageway of the rod and having an exterior recess along its shaft, wherein the rod-lock key is at least partially disposed in a rod slot and supported by the exterior recess.

18. The method of claim 17, wherein securing the rod in the second position by reengaging the rod-locking mechanism comprises:

moving the rod, the lock pin, and the rod-lock key into the annular housing interior until the rod-lock key is aligned with an interior recess along the interior surface of the annular housing;

moving the lock pin away from the biasing element biasing the lock pin with a biasing element disposed within the second passageway such that the lock pin is pushed away from the spring mechanism causing the rod-lock key to be supported by the lock pin shaft and engage the interior recess.

19. The method of claim 12, wherein ceasing fluid communication between the buffer fluid compartment and the formation, comprises:

inserting one or more sealing elements that surround the second end of the rod inside at least a portion of a cavity to prevent fluid communication between the cavity and the outlet, the cavity located in a lower fixing head positioned adjacent the pressurized gas compartment and fluidly communicating with the outlet and the second passageway.

20. A device for collecting fluid, comprising:

a self-closing system that automatically halts fluid collection once a sufficient amount of fluid has been collected; and in response to a change in a volume of fluid collected, a locking mechanism that activates a pressure compensation system in order to maintain the collected fluid in the same phase in which it was collected.

* * * * *